United States Patent [19]

Miller

[11] 4,279,743

[45] Jul. 21, 1981

[54] AIR-SPARGED HYDROCYCLONE AND METHOD

[75] Inventor: Jan D. Miller, Salt Lake City, Utah

[73] Assignee: University of Utah, Salt Lake City, Utah

[21] Appl. No.: 94,521

[22] Filed: Nov. 15, 1979

[51] Int. Cl.[3] ..... B04C 5/10

[52] U.S. Cl. ..... 209/211; 210/220

[58] Field of Search ..... 209/144, 211; 210/512 R, 512 M, 220; 55/261

[56] References Cited

U.S. PATENT DOCUMENTS

| | | | |
|---|---|---|---|
| 2,354,311 | 7/1944 | Harlow | 209/144 |
| 3,130,157 | 4/1964 | Kelsall et al. | 209/211 X |
| 3,391,787 | 7/1968 | Salomon | 210/512 R X |
| 3,489,680 | 1/1970 | Snavely, Jr. | 210/512 R X |
| 3,615,008 | 10/1971 | Alpha | 209/144 X |

*Primary Examiner*—William A. Cuchlinski, Jr.

[57] ABSTRACT

An air-sparged hydrocyclone apparatus and method, the apparatus including a substantially hollow, cyclone body having a cylindrical section and a downwardly oriented conical section. An inlet, an overflow and an underflow are also provided in the cyclone body. At least a portion of the wall of the cyclone body is modified to include an air-sparging section wherein air, under pressure, is forced into the interior of the cyclone body as a plurality of bubbles. The bubbles disrupt the boundary layer, freeing entrapped fine particles and also assist in carrying hydrophobic particles to the overflow. The introduction of discrete, small, air bubbles is enhanced by forming a portion of the wall of the cyclone body from a porous material.

11 Claims, 3 Drawing Figures

AIR-SPARGED HYDROCYCLONE AND METHOD

BACKGROUND

1. Field of the Invention.

This invention relates to hydrocyclones and, more particularly, to an air-sparged hydrocyclone apparatus and method.

2. The Prior Art of Classification.

The term "size reduction" is applied to all the ways in which particles of solids are cut or broken into smaller pieces. Comminution is a generic term for size reduction and there are various types of comminuting equipment available. The objective of the comminuting equipment is to produce small particles from larger ones, the smaller particles being desired either because of their large surface area or because of their shape, size, number, etc. Reducing the particle size has the advantage in that it increases the reactivity of solids; permits separation of unwanted ingredients by mechanical methods; and reduces the bulk of fibrous materials for easier handling. Throughout the process industries, solids are reduced by different methods for different purposes. For example, chunks of crude ore are crushed to workable size; synthetic chemicals are ground into powder; sheets of plastic are cut into tiny particles so that the geometric characteristics of particles, both alone and in mixtures, are important in evaluating the product from the comminuting equipment. Addtionally, commercial products must often meet stringent specifications regarding the size and sometimes the shape of the particles they contain.

During size reduction, the particles of feed material are first distorted and strained. The work necessary to strain the particles is stored temporarily in the solid as mechanical energy of stress, just as mechanical energy can be stored in a coil spring. As additional force is applied to the stressed particles they are distorted beyond their ultimate strength until they suddenly rupture into fragments, generating new surface. The ratio of surface area created by crushing to the energy absorbed by the solid is a measure of the crushing efficiency. The energy efficiency of the comminution operation may be thus measured by the new surface created upon reduction in size. Unlike an ideal system, actual comminution equipment does not yield a uniform product, whether the feed is uniformly sized or not. The product always consists of a mixture of particles, ranging in size from a definite maximum to a submicroscopic minimum. Some machines, especially grinding devices, are designed to control the magnitude of the largest particles in their products with little control over the fine sizes. In other types of grinding devices the production of fine sizes is minimized although not entirely eliminated.

The operating and capital costs associated with size reduction are the highest of all the unit operation costs encountered in the mineral processing industry and the cost of energy is a major portion of the operating cost. The relative magnitude of the unit operation costs in mineral processing plants are as follows: crushing, 15%; grinding, 45%; concentration, 25%; solid/liquid separation, 5%; material transport, 5%; and miscellaneous, 5%. Of these costs, the most significant is the cost incurred in operation of the grinding circuit, particularly with regard to the amount of energy consumed. It is estimated that greater than one percent of our nation's energy consumption is used for size reduction processes. As a consequence, closed-circuit grinding systems are one of the most important unit operations in the mineral processing industry and a great deal of attention has been directed toward improving the efficiency of this particular operation. Very frequently, the economic success of an entire plant will be limited by its ability to grind material to the required size specification at the desired rate.

Closed-circuit grinding is understood to involve size reduction (typically a tumbling mill, or the like) and size separation (typically a classifier). The coarse particles from the size separation are recycled to the size reduction equipment, hence the term "closed-circuit grinding." Basically two types of closed-circuit grinding operations are employed. In the first type, the fresh feed initially passes to the size reduction device (tumbling mill) followed by size separation (classification) and recycle of the coarse particles to the fresh feed. In the second type of closed-circuit grinding, fresh feed enters the size separator first with the coarse product passing to size reduction and after size reduction, rejoining the fresh feed for further classification.

Generally, these circuits are operated to maximize the production of a product with certain size specifications. It is well-documented in the literature that increased capacity can be achieved by operating at circulating loads of 200 percent or greater so that operating plants generally follow this practice. Another approach to enhance grinding circuit capacity is to grind at a higher percent solids in the mill, thus increasing throughput at no increase in power consumption. Finally, many engineers are attempting to optimize and control the performance of closed grinding circuits in order to increase capacity. Each of these techniques has resulted in varied success for improved grinding circuit capacity while relatively little attention has been focused on the classification technique and the efficiency of size separation as it is currently practiced in the industry.

However, one of the most important factors in determining the capacity of a closed grinding circuit is the efficiency of size separation. Size separation (classification) is typically accomplished with mechanical classifiers or hydrocyclones, the latter being preferred in the design of new plants. It is intuitively evident that if misplaced fine material of the desired size range is being returned along with coarse material to size reduction, the mill capacity will be reduced correspondingly. Under these circumstances, the mill will be regrinding material which is already of a suitable size. If, on the other hand, the fine material is not misplaced in the coarse material stream, the mill will have a greater capacity and the fresh feed rate can be increased.

The effect of classifier efficiency on the grinding circuit capacity is revealed in at least two computer simulation studies. In one analysis, examination of the results reveals that the grinding circuit capacity could be increased by as much as 50 percent by improved classifier efficiency. The results from another simulation suggests the grinding circuit capacity could be increased by as much as 64 percent if perfect size separation could be achieved. In view of the fact that the efficiency (as measured by the coefficient of separation which represents the fraction of feed material separated ideally) of most hydrocyclones, even under the best of circumstances, is only 50 percent and that the efficiency of mechanical classifiers is even lower, considerable improvement in grinding circuit capacity could be achieved by improved classifier efficiency.

Many excellent publications describe the operation of the hydrocyclone which is a cylindricoconical piece of equipment into which a suspension of particles is pumped under moderate pressure (10 psig, for example). The suspension is fed tangentially through a feed port causing rotation of the suspension. The flow of the suspension consists of a downward-spinning, outer spiral close to the cyclone wall and an upward-spinning, inner spiral along the axis of the hydrocyclone when oriented in a vertical direction. Particles in the suspension settle radially in the centrifugal field and those with greater mass are carried downwardly by the outer spiral and are discharged through the apex opening of the cone.

The major portion of the liquid and fine particles (coarse particles together with residual fines having been removed in the outer spiral) are forced to leave the cyclone through the overflow nozzle or vortex finder in the upward-spinning, inner spiral along the axis of the cyclone. Inside the inner spiral, a low pressure is generated creating a vortex which collects all of the air that has been carried in as bubbles or dissolved in the feed water. This visible air core is focused and stabilized by the vortex finder which extends a prescribed distance into the cylindrical section of the hydrocyclone. Because of the increase in circumferential speed of the inner spiral, higher centrifugal forces are generated which assist in keeping large particles from entering the inner spiral of the suspension so that ideally, these large particles would be prevented from reporting to the fine product collected in the overflow.

It is evident that the characteristics of the slurry fed to the cyclone influence the cut point or separation size. The particle size distribution in the slurry determines the relationship between the relative amounts of coarse product and fine product obtained. The effective slurry viscosity also influences the separation size and is determined by the solids content in the feed. Higher slurry concentrations therefore generate coarser cuts than lower concentrations. This effect can also be described in terms of hindered settling, because the movement of the coarser particles is hindered by the zone of smaller particles, through which the coarser ones must pass. The viscosity of the liquid itself acts in the same way. Furthermore, the difference in specific gravity between different particles as well as the difference in specific gravity between particles and the liquid phase is important. The shape of the particles is also important. Very flat particles such as mice tend to go to the overflow even though they may be relatively coarse. Also, overflow and underflow size distributions may be influenced by other factors such as mechanical wear which may cause continual change in the cyclone performance. Predictions of performance based on calculations from first principles are, therefore, most difficult.

To restate the nature of the flow in the hydrocyclone, particles in the suspension experience a centrifugal force which causes them to move at some radial velocity, depending upon their mass and the other factors set forth hereinbefore, toward the wall of the hydrocyclone. This radial "settling" velocity of the particles is opposed by the radial flow of the liquid toward the axis; so that, ideally, the particles will be distributed radially according to their mass. The relative magnitude of these velocity terms will determine the radial position of a given size and density particle. Between the upwardly spinning, inner spiral and the downwardly spinning, outer spiral there exists a surface of zero axial (longitudinal or vertical) velocity. Those particles which lie inside the surface of zero axial velocity (the smaller particles) will be transported through the vortex finder to the overflow. The coarse particles will be positioned outside the surface of zero axial velocity, with some thrown against the cyclone wall, and consequently, these particles will be transported through the apex to the underflow. As a result of these considerations, a size separation occurs between particles of given specific gravities.

As mentioned previously, the efficiency of this separation is far from perfect and various attempts have been made to improve the quality of the size separation process. Of course, improved efficiency can be realized by doing a two-stage separation, a technique which is practiced in some instances. Also, multiple entry systems for the feed have been suggested in order to improve cyclone performance. Some investigators have designed hydrocyclones to allow for tangential water injection through ports in the conical section with improved efficiencies having been reported, evidently due to elutriation of fine particles from the underflow product. A hydrocyclone similar to these latter designs has been marketed by Krebs Engineers, Menlo Park, Calif., for a number of years but has not had great popularity in the mineral processing industry. It appears that water injection has at least two disadvantages which are; increased difficulty in balancing water flows for specified product pulp densities; and a limited amount of water injection in order to avoid destruction of the flow pattern in the hydrocyclone. Importantly, optimum functioning of a hydrocyclone depends on constant conditions in the feed, especially the volumetric flow rate. For example, it is believed important in the prior art that air must not be sucked into the system by the feed pump since such fluctuations would tend to destroy established flow patterns and alter the steady state condition.

Numerous publications dealing with mineral processing plants, grinding circuits, and the theory, application, and operation of hydrocyclones are available, some of which are listed below 1. A. L. Mular and R. B. Bhappu, *Mineral Processing Plant Design,* SME/AIME, p. 101 (1978).

2. A. B. Cummins and I. A. Given, editors, *SME Mining Engineering Handbook,* 2, p. 31—31 (1973).

3. L. G. Austin and P. T. Luckie, "Grinding Equations and the Bond Work Index," *SME/AIME Trans.* 252, p. 259 (1972).

4. J. A. Herbst, G. A. Grandy and D. W. Fuerstenau, "Population Balance Models for the Design of Continuous Grinding Mills," *X International Mineral Processing Congress,* Institution of Mining Metallurgy, London, paper 19, (1973).

5. D. A. Dahlstrom, "Fundamentals and Applications of the Liquid Cyclone," *Chemical Engineering Prog.* Symp. Ser. No. 15, 50 p. 41–61 (1954).

6. D. F. Kelsall, "A Study of the Motion of Solid Particles in a Hydraulic Cyclone," *Trans. Institute of Chemical Engineering,* 30, p. 87–108 (1952).

7. H. Travinski, "Theory, Applications and Practical Operation of Hydrocyclones," Eng. Min. J; p. 115–127, Sept. (1976).

8. D. Bradley, *The Hydrocyclone,* Pergamon Press, 330 pp. (1965).

9. A. J. Lynch, *Developments in Mineral Processing, Mineral Crushing and Grinding,* Elsevier, p. 87–120 (1977).

10. M. D. Brayshaw, "Use of a Numerical Model to Sharpen the Hydrocyclone Efficiency Curve," Ph.D. Thesis, Department Chemical Engineering, University of Natal, Durban South Africa (1978).

11. D. A. Dahlstrom, "High Efficiency Desliming by Use of Hydraulic Water Additions to the Liquid-Solid Cyclone," *Mining Engineering and AIME Transactions, p.* 188, August (1952).

12. D. F. Kelsall and J. A. Holmes, "Improvement of Classification Efficiency in Hydraulic Cyclones by Water Injection," *V International Mineral Processing Congress,* Institution of Mining and Metallurgy, London, p. 159 (1960).

In view of the foregoing, it would be an advancement in the art to provide a novel hydrocyclone apparatus and method for improving the separation of fine particles from coarse particles in the hydrocyclone. Another advancement in the art would be to provide an improved hydrocyclone apparatus and method wherein an air sparge is introduced into the hydrocyclone apparatus for assisting in separating the fine particles from the coarse particles so that more efficient removal of fine particles in the overflow can be achieved.

3. The Prior Art of Dense Media Cyclones.

The use of dense media cyclones is well-established in the art, particularly in the area of coal preparation. This separation is based on the difference in specific gravity between components of a particulate mixture rather than on the basis of size. The equipment and basic flow patterns are essentially the same as discussed in the previous section. Certain modifications are made to accentuate separation based on specific gravity rather than size, the most significant of which is a much larger cone angle for the hydrocyclones. To accomplish this separation, a fine dispersion of magnetite or ferrosilicon is intentionally added to the system to prepare an effective liquid phase, the specific gravity of which is between the specific gravities of the two components of the feed material. The feed component with the lower specific gravity is removed in the overflow while the feed component with the higher specific gravity is removed in the underflow. The dense media is recovered and recycled.

Conventional hydrocyclones are used in this fashion to separate coal from waste as well as other cyclonic devices marketed specifically as dense media cyclones, such as the Dyna Whirlpool. A useful discussion of some of the features of these commercial models may be found in the publication COAL PREPARATION, 3rd Edition, Leonard and Mitchell, editors, SME/AIME, New York, 1968.

It would, therefore, be a further advancement in the art to provide a novel air-sparged hydrocyclone and method for use in a dense media separation mode to promote separation based on the differences in specific gravity between the components in the slurry.

4. The Prior Art of Froth Flotation.

Froth flotation involves the aggregation of air bubbles and mineral particles in an aqueous media with subsequent levitation of the bubble-particle aggregates to the surface and transfer to the froth phase. Various publications are extant on this subject. Whether or not bubble attachment and aggregation occurs is determined by the degree to which the particle's surface is wetted by water. When the surface shows little affinity for water, the surface is said to be hydrophobic (water hating) and an air bubble will attach to the surface. Accordingly, separation is based on controlled differences in particle hydrophobicity. Any water present at a hydrophobic surface can be replaced by air due to the relative magnitudes of the surface energies comprising the system. As a result, a contact angle is established which provides a measure of the surface's hydrophobicity. Since water is a polar molecule, it will only hydrate or wet a polar surface and a hydrophobic surface reflects a lack of surface polarity.

The stability of the attachment of the air bubble is measured by the contact angle developed between the three phases. When the air bubble does not displace the aqueous phase, the contact angle is zero. On the other hand, complete displacement of the water represents a contact angle of 180 degrees. Values of contact angle between these two extremes provide an indication of the degree of surface hydration, or the hydrophobic character of the surface. There are no known solids that exhibit a contact angle greater than about 105 degrees which is the value obtained with paraffin. There are few naturally hydrophobic minerals (coal, molybdenite, sulfur, talc, pyrophyllite) all of which exhibit contact angles less than 105 degrees. Most minerals are hydrophilic and as such, must acquire their hydrophobic character by the adsorption of surfactants, termed collectors, in order to achieve selective froth flotation separations.

Few minerals are naturally hydrophobic. Most minerals on fracture and breakage expose polar surfaces which are readily wetted by water. These paticles can selectively be made hydrophobic by surface chemical reactions with flotation reagents. These reagents frequently contain polar and non-polar groups in order to effect the desired hydrophobicity.

Among the flotation reagents used are those which are generally termed collectors and frothers. A collector is a reagent which adsorbs at the solid-liquid interface in such a fashion as to present a hydrophobic surface. A frother is a reagent which adsorbs at the air-water interface, the resulting reduction in surface tension establishes in the froth phase and this reagent is frequently an alcohol derivative. Activators and depressants are also identified as flotation reagents, usually inorganic, and serve to modify the behavior of the system. For example, an activator enables adsorption of the collector and is in itself generally incapable of creating a hydrophobic surface. A depressant prohibits adsorption of the collector and thus aids in maintaining selectivity.

The conventional flotation cell is, in essence, a stirred-tank reactor with certain provisions for air injection, air dispersion mechanisms, and froth removal. Conventional froth flotation circuits include a rougher section, a scavenger section, and a cleaner section which can be identified in any set of flotation cells. The rougher section is designed to establish good recovery with only a small consideration given to the grade of the product obtained. A scavenger section is designed to pick up anything missed by the rougher section with even less consideration being given to grade. The cleaner section is designed to produce a product whose grade meets the desired specifications.

Among the common separations accomplished by froth flotation are included the separation of various sulfide ores such as lead-zinc ore and copper porphyry ore and separation of non-sulfide materials such as coal, iron ore, phosphate, and potash.

In these processes, the slow drainage of misplaced hydrophilic particles from the froth phase accounts, in large measure, for the inefficiency of the separation. Consequently, the separation is accomplished in multiple stages to enhance the quality of the separation. Even so, the standard flotation cell (stirred-tank reactor with provision for air dispersion) may be inadequate to make the desired quality of separation. As a result, these cells have been modified by various manufacturers in an attempt to achieve improved performance. In addition, other techniques have been suggested and tested such as column flotation.

Numerous publications are available in the art and two of the more recent books are cited below.

1. D. W. Furstenau, editor, *Froth Flotation, 50th Anniversary Volume,* SME/AIME, pp. 677 (1962); and 2. M. C. Furstenau, editor, *Flotation, A.M. Gaudin Memorial,* Volumes 1 and 2, SME/AIME, pp. 1341 (1976).

In view of these factors, it would be an even further advancement in the art to provide a novel air-sparged hydrocyclone by which hydrophobic particles could be separated from the hydrophilic particles of a suspension. Such a novel apparatus and method is disclosed and claimed herein.

BRIEF SUMMARY AND OBJECTS OF THE INVENTION

The present invention relates to a novel hydrocyclone apparatus and method wherein a portion of the hydrocyclone is adapted to incorporate an air sparging system, the air sparging system introducing an air flow into the hydrocyclone either to improve or control the size separation or to separate hydrophobic particles from hydrophilic particles in a centrifugal field. The air sparging system is incorporated as an annular header surrounding a portion of the body of the hydrocyclone with a porous wall providing the necessary passageway for air dispersion into the hydrocyclone.

It is, therefore, a general object of this invention to provide improvements in hydrocyclone technology.

More specifically, an object of this invention is to provide an improved method for separating solids with a hydrocyclone.

Another object of this invention is to provide an air sparging system for a hydrocyclone.

Another object of this invention is to provide improvements in the efficiency and control of size separation in hydrocyclones.

Another object of this invention is to provide an air-sparged hydrocyclone for the separation of hydrophobic particles from hydrophilic particles of a suspension.

These and other objects and features of the present invention will become more fully apparent from the following description and appended claims taken in conjunction with the accompanying drawing.

DETAILED DESCRIPTION OF THE PREFERRED EMBODIMENTS

Figure 1:
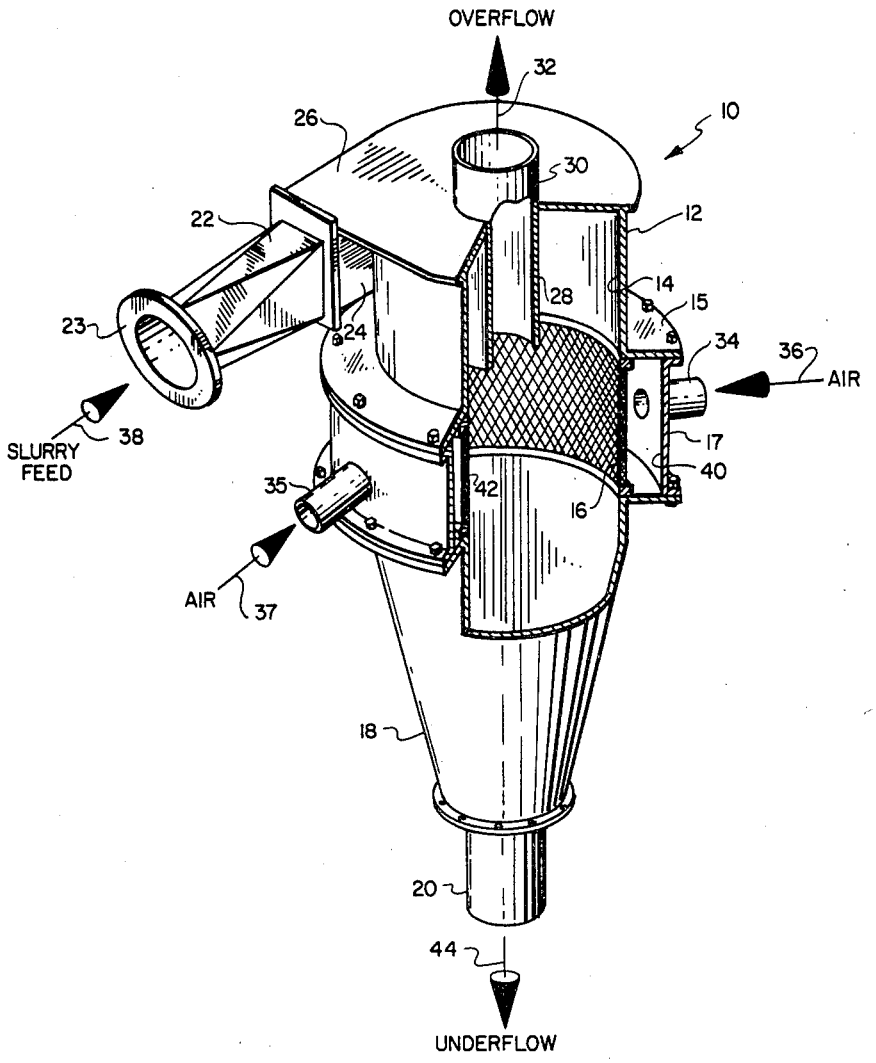
FIG. 1 is a perspective view of the improved hydrocyclone of this invention.

The invention is best understood by reference to the drawing wherein like parts are designated with like numerals throughout.

General Discussion

One of the purposes of the air-sparged hydrocyclone is to improve the efficiency of size separation and its development was based on an understanding of the principles of the conventional hydrocyclone. Inefficiency in classification by the hydrocyclone arises, in part, due to the presence of eddy currents in the upper cylindrical section. These eddy currents tend to short circuit coarse particles directly into the overflow (fine) product. Inefficiency in size separation also arises due to entrapment and transport of fine particles along the cyclone wall within a boundary layer to the apex into the underflow (coarse) product. The air-sparged hydrocyclone was designed to inhibit carry-over of these fine particles by disrupting the boundary layer and allowing the normal fluid forces to act on those fine particles that had been entrapped. In addition, it was anticipated that the design would damp out some of the eddy currents and inhibit transport of coarse particles to the overflow. In achieving either or both of these objectives, the efficiency of the size separation would be improved significantly.

The design of the novel air-sparged hydrocyclone of this invention allows for a gas (such as air) to be injected through a porous wall from an annular chamber which surrounds all or part of the cylindrical portion, the conical portion, or apex of the hydrocyclone. The radially sparged bubbles disrupt the boundary layer of particles and liquid at the cyclone wall allowing the smaller particles to escape. The design and associated phenomena are depicted schematically in FIG. 2 and FIG. 3 and will be discussed more fully hereinafter. After disrupting the layer of particles next to the wall, the bubbles move axially downwardly and radially inwardly until reaching the surface of zero axial velocity at which point they rise with the upward moving overflow stream and discharge through the vortex finder. This phenomena was clearly observed in a glass prototype of the air-sparged hydrocyclone. Some of the bubbles may be caught in the eddy currents and displace short circuiting coarse particles perhaps eventually forming an air pocket under the roof of the hydrocyclone and thereby inhibit transport of coarse particles into the overflow stream.

Modification of existing, commercially available hydrocyclones is a relatively easy matter inasmuch as the cyclone can be disassembled into a section containing the tangential feed port and the vortex finder, a cylindrical section, and a conical section containing the apex. These sections are flanged and bolted together so that the hydrocyclone is easily assembled. In the preliminary design of the air-sparged hydrocyclone, the cylindrical section was replaced with a modified cylindrical section having an annular chamber. The inner wall of the annular chamber for the first air-sparged hydrocyclone, a six-inch hydrocyclone, was constructed of suitable porous material to allow for the dispersion of air into the hydrocyclone for the disruption of the boundary layer.

This modification and possibly others such as air sparging in the conical section, or the apex, constitute the basis for the design of the unique air-sparged hydrocyclone of this invention.

In this particular example, the outer wall of the annular chamber is tapped for three ports, 120 degrees apart, around the periphery at the middle of the modified cylindrical section. Air under pressure is distributed equally to each of these ports and the total air flow rate is suitably measured and controlled.

The separation size for conventional hydrocyclones is determined principally by the cyclone diameter and is modified by changes in vortex finder diameter and apex diameter as well as changes in operating variables, for example, pressure drop and percent solids in the feed. As a result of these complex interactions between design and operating variables, it is difficult to control separation size once the design capacity has been specified. Changes in operating variables to effect a change in separation size can result in water balance problems. In the case of the air-sparged hydrocyclone, the separation size may be controlled independently of other design and operating variables by the air flow rate. Naturally, a larger separation size would be expected at higher air flow rates and the smaller separation size at low air flow rates would be limited by the design specifications for the hydrocyclone.

In addition to particle sizing by classification, flotation separations may be accomplished simultaneously and under certain circumstances, may occur exclusively. Traditional separation of particles by a flotation technique is based on the selective creation of a hydrophobic surface and subsequent separation of the hydrophobic particles from other particles due to the buoyance of bubble particle aggregates in a gravitational force field. Modification of this technique to accomplish the separation is a centrifugal force field is now possible with the air-sparged hydrocyclone apparatus and method of this invention. The dispersed air bubbles are transported radially to the axis of the cyclone together with attached hydrophobic particles (with much less dependence on particle size than in the case of particle sizing by conventional classification in a hydrocyclone) and removed through the vortex finder. Hydrophillic particles of sufficient mass are thrown to the wall by centrifugal force and discharged through the apex. This unique invention therefore allows for alternate flotation separations then those normally achieved by conventional flotation techniques.

Referring now more particularly to FIG. 1, the novel air-sparged hydrocyclone of this invention is shown generally at 10 and includes a cyclone body 12 including an inlet section 14, a cylindrical section 16, a cone section 18, an apex 20, and a vortex finder 30. A feed section 26 is interconnected with the inlet section 14 through a circular feed flange 23 having a conversion section 22 interconnected with an involuted feed entry 24 for changing the profile of the flow stream from circular to a rectangular and a tangentially oriented, involuted feed entry. The involuted feed entry 24 provided through this apparatus tangentially introduces a slurry feed 38 while minimizing turbulence of slurry feed 38 entering the cyclone body 12. The minimal turbulence in the cyclone inlet head section 14 permits a fine separation by providing near laminar flow of the slurry feed 38 by reducing the turbulence therein, which turbulence causes undesirable mixing of slurry feed 38.

A vortex finder 28 extends axially into the cyclone body 12 a predetermined distance, the determination of which is based upon well-known principles in the art. Overflow product, shown schematically at arrow 32, passes upwardly through an outlet 30 formed as an extension to vortex finder 28.

Cylindrical section 16 is interconnected to inlet section by a flange 15 and is configurated as an air-sparging section and includes an air plenum 40 created between a porous wall 42 and an air plenum housing 17. Pressurized air, indicated schematically by arrows 36 and 37, is introduced into air plenum 40 through inlet ports 34 and 35, respectively. The operation of air-sparging section 16 will be discussed more fully hereinafter with respect to FIGS. 2 and 3.

Conical section 18 extends downwardly from cylindrical section 16 and is provided with a predetermined angle of convergence to provide the appropriate separation as predetermined for the products being processed through air-sparged hydrocyclone 10. The technology regarding the profile of conical section 18 is well-known in the art and is, therefore, not detailed more thoroughly herein.

Apex 20 includes an orifice (not shown) which is designed to discharge the coarse solids that are being separated by the air-sparged hydrocyclone 10. The technology surrounding orifice design of apex 20 is also well-known in the art and will not be detailed herein although the apex orifice must be large enough to discharge the coarse solids while permitting the entry of air along the axis of the cyclone body 12 in order to establish an air core therein. In particular, the high angular velocity of the pulp surrounding the air core (not shown) creates a low pressure condition that will draw air into the cyclone body 12 through the orifice (not shown) of apex 20. All of the air entering the cyclone housing 12 will discharge with the cyclone overflow 32. Too small an apex orifice will create a spiralling, solid underflow stream, often referred to as a "rope discharge" with a result that some coarse solids that should discharge as underflow 44 are forced out with overflow 32. On the other hand, too large an apex orifice causes a larger, hollow cone pattern with a result that the underflow 44 will be excessively wet, the additional water therein carrying fine solids that would otherwise report to overflow 32. Adaptation of the air sparge technique to cyclone separators in which an air core is not formed may also be possible.

Figure 2:
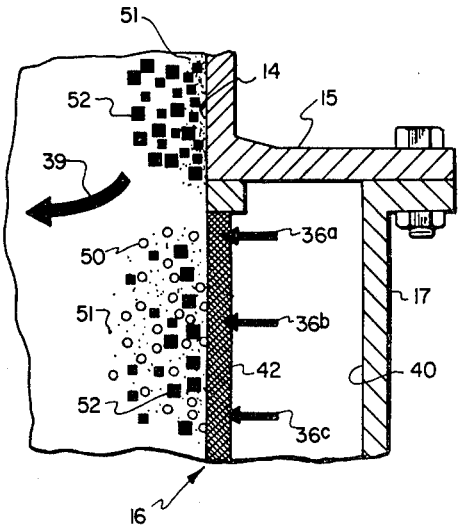
FIG. 2 is an enlarged cross-section of a portion of the air-sparging section of FIG. 1 showing the effect of air flow on promoting the efficiency of size separation.

Referring now more particularly to FIG. 2, an enlargement of a portion of the air-sparging section 16 is shown with the function thereof being illustrated schematically. Pressurized air inside the air plenum 40 is shown schematically as arrows **36*a*-36*c* passes through porous wall 42 where the resultant bubbles, bubbles 50, disrupt the compaction of particles 51 and 52 allowing the cyclone action, illustrated schematically by arrow 39, to provide a more thorough separation of the various particles. In particular, coarse particles 52 and fine particles 51 tend to be compacted adjacent to the inlet wall of inlet housing 14 by the centrifugal forces acting thereon. This "compaction" causes the mechanical entrapment of fine particles 51 by coarse particles 52 as both are subjected to centrifugal forces upon entry into cyclone body 12. This problem is illustrated schematically at the upper portion of FIG. 2 and is believed to be one of the primary causes for the relatively inefficient separation of particles 51 and 52** in a conventional hydrocyclone. However, upon reaching the upper end of porous wall 42, air under pressure passing through porous wall 42 forms bubbles 50 which disrupt compaction of particles 51 and 52 causing them to be forced away from porous wall 42 with a result that the cyclone action 39 is able to pick up a greater percentage of fine particles 51 carrying the same to overflow 32 (FIG. 1). Accordingly, the radially injected bubbles 50 from air flow 36*a*-36*c* disrupts the boundary layer of particles 51 and 52 in the liquid allowing the smaller particles 51 to escape. After disrupting this layer of particles next to the wall, the bubbles move downwardly axially and also radially inwardly until reaching the surface of zero axial velocity at which point they rise with the upward moving overflow stream and discharge through the vortex finder 28 as overflow 32. Some of bubbles 50 passing through porous wall 42 are caught in the eddy currents and displace short circuiting coarse particles 52 and also possibly forming an air pocket underneath roof 26 which air pocket further inhibits transport of coarse particles 52 into the overflow stream 32.

Figure 3:
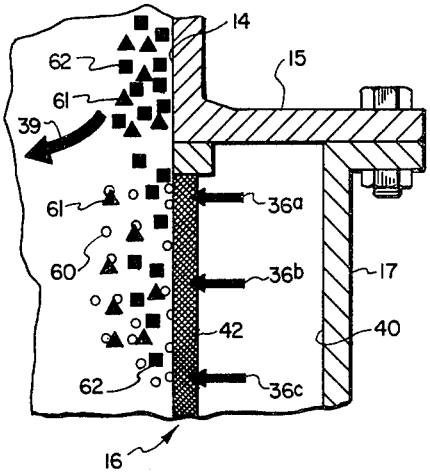
FIG. 3 is another enlarged cross-section of the air-sparging section of the novel hydrocyclone of this invention showing the preferential attachment of air bubbles to the hydrophobic particles (triangles) for their separation from the hydrophilic particles (squares).

Advantageously and surprisingly, the novel air-sparged hydrocyclone 10 of this invention is particularly useful for the separation of hydrophobic particles by mixing appropriate flotation reagents, when necessary, with the inlet feed 38. Referring particularly to FIG. 3, incoming air bubbles 60 through porous wall 42 attach to and thereby carry hydrophobic particles 62 (shown schematically as triangular shapes) away from porous wall 42 and permit the same to be removed with overflow 32 (FIG. 1). Accordingly, the introduction of air allows a greater separation of the hydrophobic particles under the centrifugal forces with a resulting carry-over of otherwise heavier hydrophobic particles into overflow 32. Representative applications of the foregoing are useful in the treatment of copper porphyry ore wherein the air-sparged hydrocyclone 10 will be used in the closed-circuit grinding process as a pre-separation process. A second application would be in the separation of coal from a slurry of coal and waste. Since coal is naturally hydrophobic and has a low gravity and low mass, it is easily separated using the novel air-sparged hydrocyclone of this invention. Additional applications are readily foreseen based upon the novel air-sparging system of this invention.

In summary, the novel air-sparged hydrocyclone apparatus and method of this invention may provide improved size separations as well as separation of hydrophobic particles wherein those particles are either naturally hydrophobic or rendered such by conventional techniques. Additionally, although only a portion of the cylindrical section 16 is shown as having been converted into the air-sparging section by the inclusion therein of porous wall 42, it is to be particularly understood that the embodiment of FIG. 1 is illustrative only since the novel air-sparging section may be placed at any suitable location in the air-sparged hydrocyclone 10 of this invention including, for example, as part of conical section 18 as well as even apex 20.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A gas-sparged hydrocyclone apparatus comprising:
   - a substantially hollow cyclone body;
   - entry means for introducing a particulate mixture into the cyclone body, the particulate mixture being carried in a liquid phase;
   - overflow means for removing overflow product from the cyclone body;
   - underflow means for removing underflow product from the cyclone body;
   - a gas plenum surrounding at least a portion of the hollow cyclone body; and
   - a porous wall means separating the gas plenum from the hollow cyclone body, the porous wall in combination with a pressurized gas in the gas plenum thereby comprising sparging means for introducing gas into the cyclone body to assist in separating the particulate mixture.

2. The cyclone separator defined in claim 1 wherein the cyclone body comprises a generally cylindrical section and a downwardly oriented, conical section.

3. The cyclone separator defined in claim 2 wherein the plenum surrounds at least a portion of the cylindrical section of the cyclone body.

4. The cyclone separator defined in claim 2 wherein the plenum surrounds at least a portion of the conical section of the cyclone body.

5. The cyclone separator defined in claim 2 wherein the plenum surrounds at least a portion of the apex of the conical section.

6. A cyclone separator comprising:
   - a substantially hollow cyclone body;
   - inlet means for introducing a liquid-based slurry into the cyclone body;
   - overflow means for removing overflow product from the cyclone body;
   - underflow means for removing underflow product from the cyclone body; and
   - gas sparging means for forcing gas into the cyclone body, the gas sparging means comprising a gas plenum surrounding a portion of the cyclone body with a wall of the cyclone body underlying the gas plenum comprising a porous wall to permit the passage of gas under pressure from the plenum into the cyclone body.

7. A method for improving separation of solids comprising:
   - producing a slurry of the solids;
   - introducing the slurry into a hydrocyclone, the hydrocyclone including an overflow and an underflow;
   - sparging the hydrocyclone with air by directing air through the wall of the hydrocyclone, the air disrupting the boundary layer in the hydrocyclone thereby releasing particles entrapped therein and allowing the particles to be carried to the overflow of the hydrocyclone with the residue being carried to the underflow.

8. The method defined in claim 7 wherein the producing step further comprises obtaining a slurry comprising hydrophobic particles and hydrophilic particles and carrying hydrophobic particles to the overflow with air bubbles introduced into the hydrocyclone during the sparging step.

9. A method for improving solids separation of a cyclone comprising:

forming a porous wall as part of the internal cyclone wall;

introducing a liquid-based suspension of solids tangentially into a cyclone; and injecting a gas through the porous wall into the liquid-based suspension thereby disrupting the boundary layer along a portion of the internal wall of the cyclone.

10. A cyclone separator comprising:

a hollow shell having a downwardly tapered lower section;

feed means for introducing liquid-based slurry material tangentially into the hollow shell; and gas sparging means for introducing gas into the hollow shell from an external surface of the hollow shell, said gas sparging means comprising a porous wall as part of the hollow shell and a gas plenum surrounding the porous wall.

11. The cyclone separator defined in claim 10 wherein the sparging means comprises an annular ring around the hollow shell and including a plurality of openings into the hollow shell.

* * * * *